United States Patent [19]

Kaufhold

[11] Patent Number: 4,976,362

[45] Date of Patent: Dec. 11, 1990

[54] PULLING LUG FOR RAILWAY VEHICLE COUPLER

[75] Inventor: Horst T. Kaufhold, Chicago, Ill.

[73] Assignee: AMSTED Industries Incorporated, Chicago, Ill.

[21] Appl. No.: 389,548

[22] Filed: Aug. 4, 1989

[51] Int. Cl.[5] ..... B61G 3/04; B61G 3/00

[52] U.S. Cl. ..... 213/152; 213/100 R; 213/109

[58] Field of Search ..... 213/100 R, 100 W, 104, 213/105, 109, 110, 151, 152, 155

[56] References Cited

U.S. PATENT DOCUMENTS 538,029 4/1895 Shwanger et al. ..... 213/104
560,910 5/1896 Meeker et al. ..... 213/152
1,152,138 8/1915 Bazeley ..... 213/152

FOREIGN PATENT DOCUMENTS 479861 1/1952 Canada ..... 213/152

*Primary Examiner*—Robert P. Olszewski
*Assistant Examiner*—S. Joseph Morano
*Attorney, Agent, or Firm*—Charles E. Bouton; Edward J. Brosius

[57] ABSTRACT

A railway coupler is provided having a coupler head comprising pulling lugs, behind which compound fillets of variable increasing radii have been inserted. The compound fillets reduce the stress concentration behind the lugs by distributing load over a greater curved surface area in order to decrease the possibility of fatigue cracking and failure of the pulling lugs.

8 Claims, 3 Drawing Sheets

PULLING LUG FOR RAILWAY VEHICLE COUPLER

BACKGROUND OF THE INVENTION

The present invention relates to railway vehicle couplers and more particularly to an improved railway coupler head having pulling lugs with compound fillets.

Both AAR Type E and Type F railway coupler heads are known to have pulling lugs. Further, both type coupler heads are known with upper and lower pulling lugs. The purpose of such pulling lugs is to receive the transferred draft load from an interfacing pulling surface of a knuckle which receives the transferred draft load from a knuckle of a mating coupler head.

The pulling lugs used currently on coupler heads have a knuckle interface surface comprising a substantially vertical pulling surface which extends into a radial fillet having a constant radius. The fillet connects the vertical pulling surface with a substantially horizontal surface adjacent a second radial fillet also having a constant radius at a raised boss for a thrower hole. With the introduction of high mileage and high load unit trains, forces acting on the pulling lugs of both type coupler heads have increased drastically.

A problem that has occurred in the currently used pulling lugs with the advent of increased mileage and loads, is the formation of fatigue cracks behind the pulling lug at the junction of the radial fillet with the horizontal surface. If these cracks become too great, the pulling lugs can fracture causing the coupled connection to fail. Such potential failure is a serious enough problem to consider modification of the coupler head design.

SUMMARY OF THE INVENTION

Accordingly, it is an object of the present invention to provide an improved pulling lug on both type coupler heads that will lessen the potential for fatigue cracking.

By the present invention, it is proposed to overcome the difficulties encountered heretofore. To this end, it has been discovered that using a compound fillet having a variable radius instead of a fillet having a constant radius greatly reduces the stress concentration along the pulling lug by distributing the stresses more evenly over a greater surface area. While a parabolic-shaped compound fillet is preferred, other curves having variable radii such as ellipses or catanaries could also be used to reduce the stress concentration. This reduction of stress concentration, in turn, reduces the likelihood of fatigue cracks behind the pulling lugs.

DESCRIPTION OF THE PREFERRED EMBODIMENT

Figure 2:
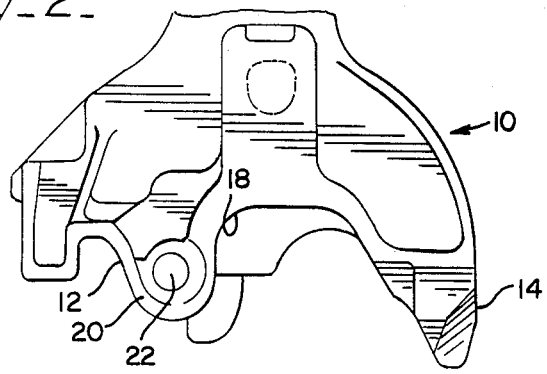
FIG. 2 is a partial top plan view of the F Type coupler head shown in FIG. 1.
Figure 1:
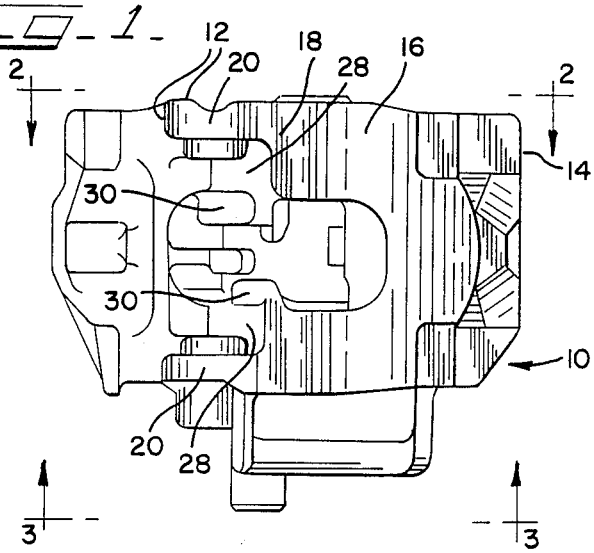
FIG. 1 is a front elevation view along the longitudinal center line of an F Type coupler head.
Figure 3:
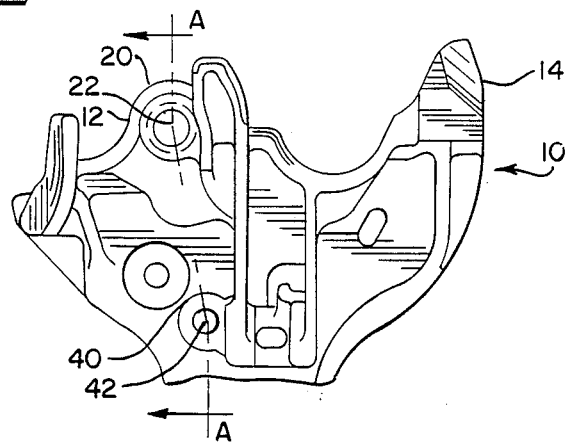
FIG. 3 is a partial bottom plan view of the F Type coupler head shown in FIG. 1.

In FIGS. 1–4, an F Type coupler head is shown generally at 10. The knuckle side of the coupler is shown at 12, and the guard arm side at 14. As best seen in FIG. 1, coupler front face 16 has a generally flat, vertical planar section. Coupler face 16 includes throat portion 18 extending toward knuckle side 12 in a curved manner toward pivot lugs 20 having pin holes 22. It is within pivot lugs 20 that a knuckle 24 is received and retained in a pivotal manner with a pin (not shown) that extends through pin holes 22 and a corresponding hole 26 in knuckle 24. Located behind pivot lugs 20 are buffing shoulders 28 which form a pocket for receiving knuckle 24.

Figure 4:
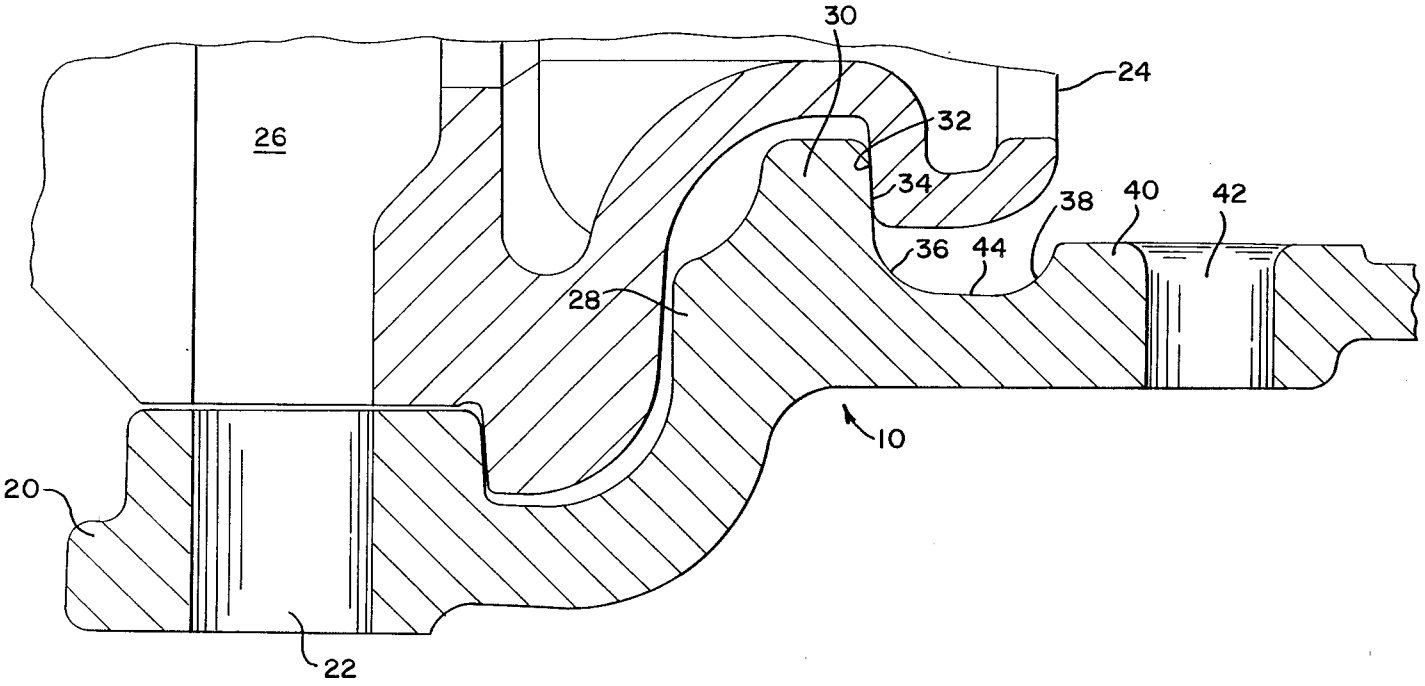
FIG. 4 PRIOR ART
FIG. 4 is an enlarged partial sectional elevation view taken substantially along line A—A of FIG. 3 showing a prior art pulling lug in which an interfacing knuckle has been added.

Projecting from buffing shoulders 28 are pulling lugs 30 behind which are engaged by ccrresponding pulling surfaces 32 of knuckle 24. FIG. 4 shows the prior art design profile of a bottom pulling lug 30. It is to be understood that the design profile in top and bottom pulling lugs 30 are similar. Pulling lug 30 includes a knuckle interface comprising a substantially vertical pulling surface 34 which extends into a radial fillet 36 having a constant radius. Coupler head 10 also includes a second fillet 38 also of constant radius which forms the left-half portion of a raised boss 40 for a thrower hole 42. Thrower hole 42 receives a pivot portion of a thrower (not shown) which rotates around to throw open knuckle 24 during uncoupling. Located between and separating radial fillet 36 from raised boss 40 is a substantially flat surface 44. It is at the junction between radial fillet 36 and flat surface 44 where fatigue cracks have been found to form.

Figure 5:
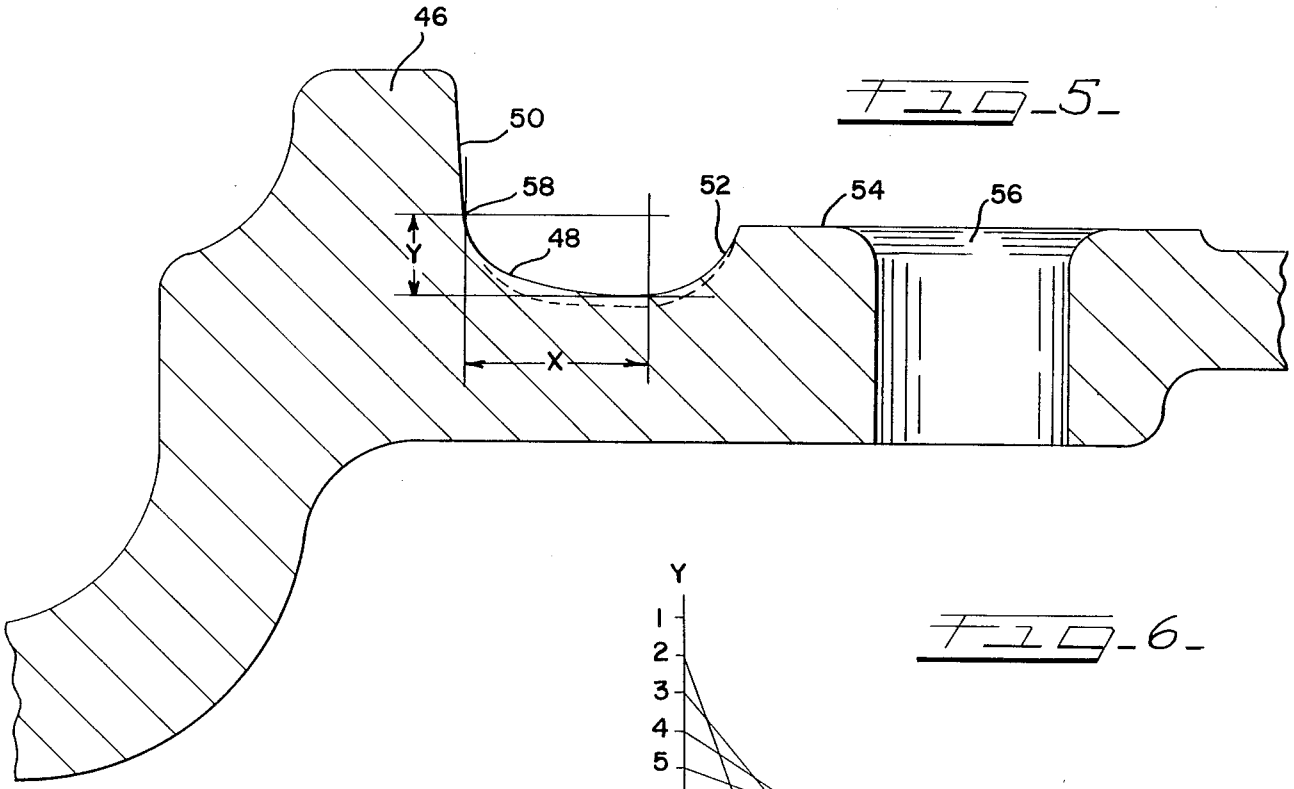
FIG. 5 is an enlarged partial sectional elevation view taken substantially along line A—A of FIG. 3 in which a preferred design profile of the present invention has been added and is shown in comparison to the prior art design profile (dashed)

FIG. 5 shows a bottom pulling lug 46 embodying the improved design of the present invention. The radial fillet of constant radius has been replaced with a parabolic fillet 48 having a variable radius that increases with the distance away from an unchanged substantially vertical surface 50. In addition, substantially flat surface 44 which was located between radial fillet 36 and raised boss 40 in the prior art design profile of FIG. 4 has been eliminated. In the improved design, parabolic fillet 48 extends into a second fillet 52 of constant radius at a raised boss 54 for thrower hole 56, said boss 54 and thrower hole 56 being unchanged over the prior art design profile. The prior art design profile is shown in dashed lines in FIG. 5 to illustrate the modifications in said improved design profile.

The substitution of parabolic fillet 48 and the resulting elimination of substantially flat surface 44 from the prior art design profile greatly reduces the stress concentration between substantially vertical surface 50 and raised boss 54 by distributing the load over a larger, smoother curved surface area, namely along the entire parabolic curve 48, instead of the mere radial fillet 36 of the prior art design profile. This reduction in stress concentration reduces the likelihood of fatigue cracks forming behind the pulling lugs.

Figure 6:
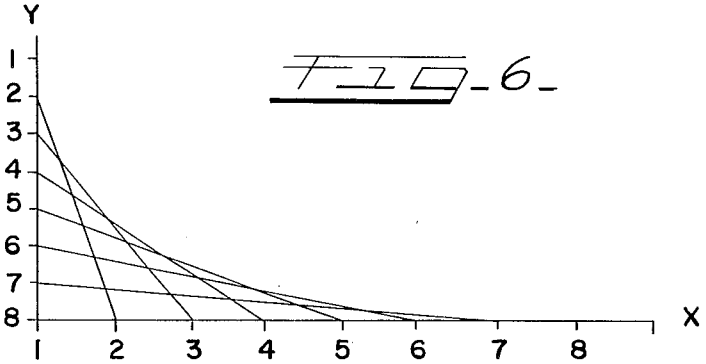
FIG. 6 is a graph depicting the approximation of an example of a parabolic curve in accordance with the preferred embodiment of the invention.

A parabolic fillet is preferred due to the small space envelope which is available along the x and y axes as shown in FIG. 5. The distance along the y axis remains unchanged over the prior art pulling lug design because the fillet may not extend any higher into substantially vertical surface 50 which interfaces with a corresponding pulling surface on a knuckle. Such an extension of the fillet would result in the loss of interchangeability with knuckles of standard design. The distance along the x axis is greater in the improved design, however, as the parabolic fillet 48 eliminates substantially flat surface 44 of the prior art design profile of FIG. 4. To construct an approximate parabolic fillet 48 profile, the distances along the x and y axes may be divided into the same number of segments and identically numbered from top to bottom and from left to right as shown in FIG. 6. Points having the same number are then connected by straight lines resulting in an envelope of gradually increasing radius which approximates a parabolic curve.

The parabolic fillet can also be constructed using the parabolic equation $y^2=2fx$ with the origin of the parabola located at point 58 where the substantially vertical surface 50 meets the fillet 48 as shown in FIG. 5. The constant f in the parabolic equation is selected in accordance with the x and y space limits for the given pulling lug.

While a parabolic fillet is preferred, other compound curves of variable radii such as ellipses or catanaries would also reduce the stress concentration. Furthermore, while an F Type coupler head is shown in the drawings, identical modifications could be made to the pulling lugs of an E Type Coupler to achieve the same result.

The foregoing description and drawings explain and illustrate the best known mode of the invention and those skilled in the art who have the disclosure before them will be able to make modifications and variations therein without departing from the scope of the invention which is defined in the following claims.

What is claimed is:

1. A railway vehicle coupler comprising a head including at least one pulling lug, said pulling lug having a substantially vertical pulling surface for cooperation with a corresponding pulling surface on a knuckle, said substantially vertical pulling surface extending downwardly to engage a compound fillet having a variable radius, said compound fillet located behind said pulling lug and extending from said vertical pulling surface to a second radial fillet at a raised boss for a thrower hole, said variable radius of said compound fillet which increases with distance away from said substantially vertical pulling surface.

2. The invention according to claim 1 in which said compound fillet has a profile which approximates that of a parabolic curve.

3. The invention according to claim 1 in which said compound fillet has a profile which approximates that of a catenary curve.

4. The invention according to claim 1 in which said compound fillet has a profile which approximates that of an elliptic curve.

5. A railway vehicle coupler comprising a head including upper and lower pulling lugs, each of said pulling lugs having a substantially vertical pulling surface for cooperation with a corresponding pulling surface on a knuckle, said substantially vertical pulling surface extending downwardly to engage a compound fillet having a variable radius, said compound fillet located behind each of said pulling lugs, each of said compound fillets extending from said corresponding vertical pulling surface to a respective second radial fillet at a raised boss for a thrower hole, said variable radius of each of said compound fillets which increases with distance away from said corresponding vertical pulling surface.

6. The invention according to claim 5 in which said compound fillet has a profile which approximates that of a parabolic curve.

7. The invention according to claim 5 in which said compound fillet has a profile which approximates that of a catenary curve.

8. The invention according to claim 5 in which said compound fillet has a profile which approximates that of an elliptic curve.

* * * * *